US009273899B2

(12) United States Patent
Kevenaar et al.

(10) Patent No.: US 9,273,899 B2
(45) Date of Patent: Mar. 1, 2016

(54) METHOD AND APPARATUS FOR COOLING A HYDROCARBON STREAM

(75) Inventors: Mark Antonius Kevenaar, The Hague (NL); Johan Jan Barend Pek, The Hague (NL); Chun Kit Poh, The Hague (NL)

(73) Assignee: Shell Oil Company, Houston, TX (US)

( * ) Notice: Subject to any disclaimer, the term of this patent is extended or adjusted under 35 U.S.C. 154(b) by 1973 days.

(21) Appl. No.: 12/444,852

(22) PCT Filed: Oct. 11, 2007

(86) PCT No.: PCT/EP2007/060808
§ 371 (c)(1),
(2), (4) Date: Apr. 9, 2009

(87) PCT Pub. No.: WO2008/043806
PCT Pub. Date: Apr. 17, 2008

(65) Prior Publication Data

US 2010/0037654 A1 Feb. 18, 2010

(30) Foreign Application Priority Data

Oct. 11, 2006 (EP) ..... 06122102

(51) Int. Cl.
*F25J 1/00* (2006.01)
*F25J 1/02* (2006.01)

(52) U.S. Cl.
CPC ..... *F25J 1/0022* (2013.01); *F25J 1/0052* (2013.01); *F25J 1/0214* (2013.01); *F25J 1/0223* (2013.01); *F25J 1/0254* (2013.01); *F25J 1/0265* (2013.01); *F25J 1/0292* (2013.01); *F25J 2270/12* (2013.01); *F25J 2270/18* (2013.01)

(58) Field of Classification Search
CPC ..... F25J 1/0022; F25J 1/0052; F25J 1/0292; F25J 1/0254; F25J 1/0265; F25J 1/0214; F25J 1/0223; F25J 2270/12; F25J 2270/18
USPC ..... 62/612, 614, 606, 611
See application file for complete search history.

(56) References Cited

U.S. PATENT DOCUMENTS 4,334,902 A * 6/1982 Paradowski ..... 62/614
4,339,253 A 7/1982 Caetani et al. ..... 62/40
4,548,629 A * 10/1985 Chiu ..... 62/621

(Continued)

FOREIGN PATENT DOCUMENTS

DE 19728153 1/1999 ..... F25J 1/00
DE 29823450 6/1999 ..... F25J 1/02

(Continued)

*Primary Examiner* — Frantz Jules
*Assistant Examiner* — Keith Raymond

(57) ABSTRACT

A hydrocarbon stream (30), such as natural gas, is commonly cooled together with a first refrigerant stream (140), against an evaporating refrigerant (24) in a series of one or more consecutively arranged common heat exchangers (2), which comprises a first common heat exchanger, upstream of which first common heat exchanger the hydrocarbon stream (10) and the first refrigerant stream (130) are not commonly cooled (4, 3). The hydrocarbon stream to be cooled is fed into the first common heat exchanger at a hydrocarbon feeding temperature, while the first refrigerant stream is fed into the first common heat exchanger at a refrigerant feeding temperature. The temperature difference between the hydrocarbon feeding temperature and the refrigerant feeding temperature is lower than 60 C.

15 Claims, 4 Drawing Sheets

(56) References Cited

U.S. PATENT DOCUMENTS

| | | | | |
|---|---|---|---|---|
| 4,778,497 | A * | 10/1988 | Hanson et al. | 62/613 |
| 4,970,867 | A * | 11/1990 | Herron et al. | 62/613 |
| 6,105,389 | A | 8/2000 | Paradowski et al. | 62/613 |
| 6,370,910 | B1 | 4/2002 | Grootjans et al. | 62/613 |
| 7,386,996 | B2 * | 6/2008 | Fredheim et al. | 62/612 |
| 2004/0083888 | A1 * | 5/2004 | Qualls | 95/227 |

FOREIGN PATENT DOCUMENTS

| | | | |
|---|---|---|---|
| DE | 102005000647 | 7/2006 | F25J 1/00 |
| WO | WO2006108952 | 10/2006 | F25J 1/02 |

* cited by examiner

METHOD AND APPARATUS FOR COOLING A HYDROCARBON STREAM

The present application claims priority from European Patent Application 06122102.4 filed 11 Oct. 2006.

FIELD OF THE INVENTION

The present invention relates to a method for cooling a fluid hydrocarbon stream, such as a natural gas stream, in particular to obtain a liquefied hydrocarbon stream, such as liquefied natural gas (LNG).

BACKGROUND OF THE INVENTION

Several methods of cooling and liquefying a hydrocarbon stream such as natural gas stream are known. It is desirable to liquefy natural gas stream for a number of reasons. As an example, natural gas can be stored and transported over long distances more readily as a liquid than in gaseous form, because it occupies a smaller volume and does not need to be stored at high pressures.

An example of a method for liquefying natural gas is described in U.S. Pat. No. 6,370,910.

Although the method according to U.S. Pat. No. 6,370,910 already give satisfying results, it has been found that if the natural gas provided is at temperatures significantly differing from the temperature of the refrigerants, thermal stresses due to differential expansions and internal pinches may occur in the cooling equipment. This problem may even be more pertinent during the winter months and/or in cold areas such as the Arctic region as a result of which the natural gas is provided at relative low temperatures.

Apart from equipment related problems, the above may result in a lower thermal efficiency for the cooling or liquefaction process.

It is an object of the present invention to minimize one or more of the above problems.

It is a further object of the present invention to provide an alternative method for cooling, in particular liquefying, a hydrocarbon stream.

SUMMARY OF THE INVENTION

The present invention provides a method for cooling a hydrocarbon stream such as natural gas, wherein the hydrocarbon stream and a first refrigerant stream are commonly cooled against an evaporating refrigerant in a series of one or more consecutively arranged common heat exchangers, which series comprises a first common heat exchanger, upstream of which first common heat exchanger the hydrocarbon stream and the first refrigerant stream are not commonly cooled, the method at least comprising the steps of:

(a) compressing a first refrigerant stream to obtain a compressed first refrigerant stream;

(b) cooling the compressed first refrigerant stream against ambient to a refrigerant temperature;

(c) receiving a hydrocarbon stream to be cooled at a starting temperature that is lower than the refrigerant temperature;

(d) feeding the hydrocarbon stream into the first common heat exchanger at a hydrocarbon feeding temperature that is lower than the refrigerant temperature;

(e) further lowering the temperature of the first refrigerant stream, after said cooling of step (b), by heat exchanging against a medium different from ambient;

(f) feeding the first refrigerant stream into the first common heat exchanger, after said heat exchanging of step (e), at a refrigerant feeding temperature that is lower than the refrigerant temperature, the temperature difference between the hydrocarbon feeding temperature and the refrigerant feeding temperature being lower than 60° C.

Said temperature difference preferably is smaller than an initial temperature difference between said starting temperature of said hydrocarbon stream and said refrigerant temperature.

In another aspect, the invention provides an apparatus for cooling a hydrocarbon stream such as natural gas, the apparatus comprising:

- a first refrigerant stream;
- a compressor arranged to compress the first refrigerant stream to obtain a compressed first refrigerant stream;
- an ambient cooler arranged to cool the compressed first refrigerant stream against ambient to a refrigerant temperature;
- a pre-cooling heat exchanger arranged to receive the cooled compressed first refrigerant stream and to further lower the temperature of the first refrigerant stream by heat exchanging against a medium different from ambient;
- a hydrocarbon source arranged to provide a hydrocarbon stream to be cooled at a starting temperature that is lower than the refrigerant temperature;
- a series of one or more consecutively arranged common heat exchangers arranged to receive and commonly cool at least the hydrocarbon stream and the first refrigerant stream, which series comprises a first common heat exchanger, such that upstream of which first common heat exchanger there is no other common heat exchanger wherein the hydrocarbon stream and the first refrigerant stream can be commonly cooled;
- a hydrocarbon inlet on the first common heat exchanger arranged to receive the hydrocarbon stream at a hydrocarbon feeding temperature lower than the refrigerant temperature;
- a first refrigerant inlet on the first common heat exchanger arranged to receive the first refrigerant from the pre-cooling heat exchanger at a refrigerant feeding temperature that is lower than the refrigerant temperature, and such that the temperature difference between the hydrocarbon feeding temperature and the refrigerant feeding temperature is lower than 60° C.

It has been found that using the surprisingly simple method and apparatus according to the present invention, thermal stresses due to differential expansions and internal pinches can be significantly minimized.

BRIEF DESCRIPTION OF THE DRAWINGS

Hereinafter the invention will be further illustrated by the following non-limiting drawing. Herein shows.

DETAILED DESCRIPTION OF THE INVENTION

Figure 1:
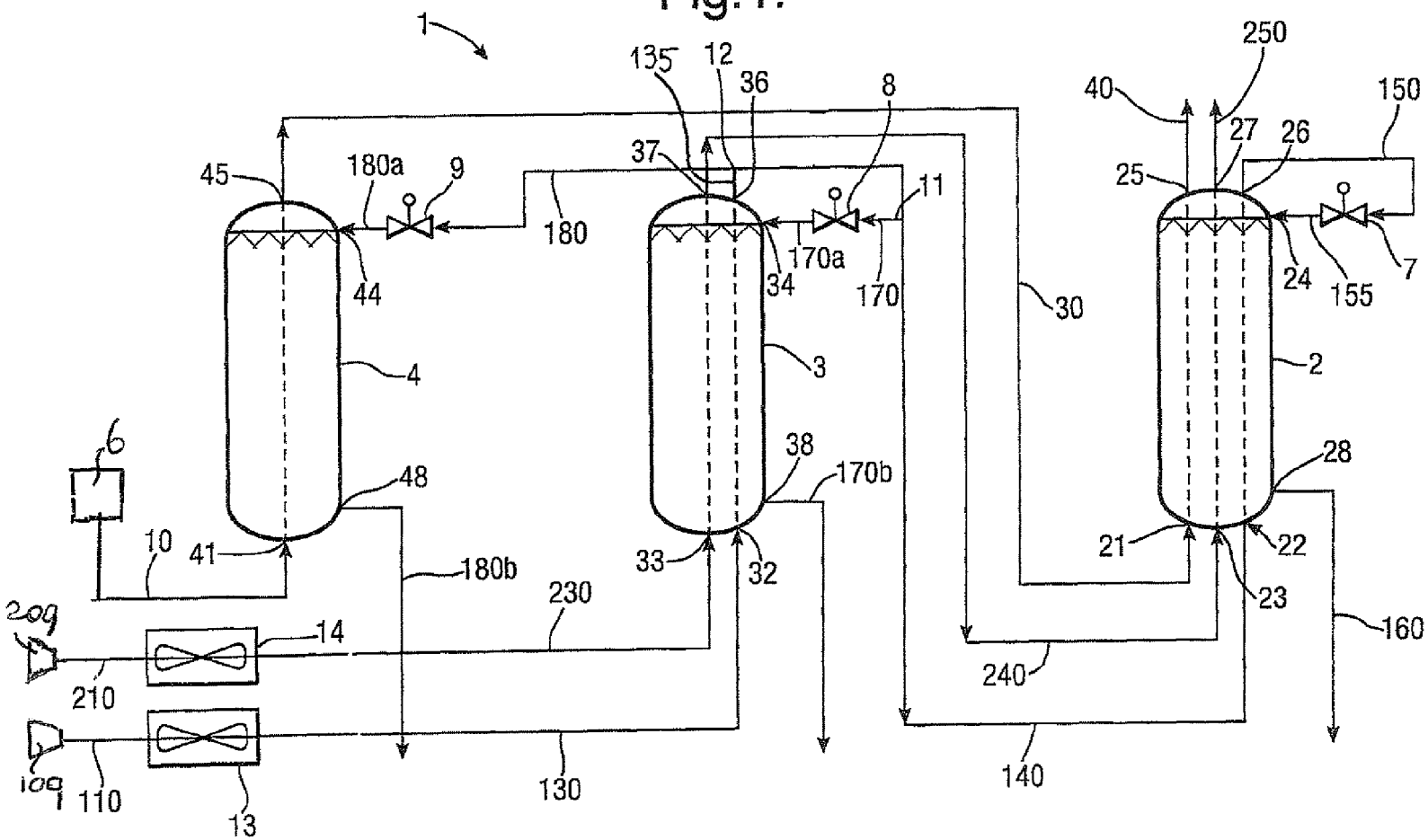
FIG. 1 schematically a process scheme of a first embodiment in accordance with the present invention.

For the purpose of this description, a single reference number will be assigned to a line as well as a stream carried in that line. Same reference numbers refer to similar components.

A hydrocarbon stream, such as natural gas, is commonly cooled together with a first refrigerant stream, against an evaporating refrigerant in a series of one or more consecutively arranged common heat exchangers. The series of one or more consecutively arranged common heat exchangers comprises a first common heat exchanger, upstream of which first common heat exchanger the hydrocarbon stream and the first refrigerant stream are not commonly cooled. Stated differently, the first common heat exchanger is understood to be the upstream-most one of any common heat exchangers arranged to commonly cool at least the hydrocarbon stream and the first refrigerant stream.

The hydrocarbon stream to be cooled is fed into the first common heat exchanger at a hydrocarbon feeding temperature, while the first refrigerant stream is fed into the first common heat exchanger at a refrigerant feeding temperature. The temperature difference between the hydrocarbon feeding temperature and the refrigerant feeding temperature is lower than 60° C., preferably lower than 40° C., more preferably lower than 20° C., even more preferably lower than 10° C., most preferably lower than 5° C.

An important advantage of the present invention is that, in particular when the there is a large temperature difference between on the one hand the hydrocarbon stream to be cooled and on the other hand at least one (preferably all) of the first and second (and any further) refrigerants to be fed to the same heat exchanger, the temperatures are leveled to about the same temperature thereby avoiding internal pinch and thermal stresses due to differential expansions which may occur in e.g. a spool wound heat exchanger.

Under specific circumstances, e.g. when the hydrocarbon stream arrives—for instance via a pipe line—from a hydrocarbon source located in a colder geographic region, the hydrocarbon stream may at the start of the method be colder than the refrigerant temperature of the first refrigerant leaving the ambient coolers that are usually provided in a refrigerant circuit to remove compression heat from the refrigerant. The hydrocarbon stream may already thus carry cold that has not been put in by actively applying a cooling duty, such as by any compression/expansion. This cold is preferably preserved.

By further cooling the ambient-cooled first refrigerant against a medium different from ambient, the refrigerant temperature can be brought closer to the hydrocarbon temperature without needing to put in additional heating duty to warm the hydrocarbon stream.

If the hydrocarbon stream is provided at cold temperatures such as may be the case in winter months or in cold areas such as the Arctic region, this cold may be used to cool the refrigerants as a result of which less cooling duty is required to cool the first refrigerant and optional second refrigerant.

The cooled hydrocarbon stream, after having passed through the series of one or more common heat exchangers, may be removed from the series of said one or more common heat exchangers and optionally further cooled in at least a second heat exchanger to obtain a liquefied hydrocarbon stream.

Described below are three embodiments of a method that comprises the steps of:

feeding a hydrocarbon stream to be cooled, a first refrigerant, and optionally a second refrigerant, into and passing through a first heat exchanger, wherein the temperature difference of the hydrocarbon stream and at least one of the first and optional second refrigerants when feeding into the first heat exchanger is lower than 60° C., preferably lower than 40° C., more preferably lower than 20° C., even more preferably lower than 10° C., most preferably lower than 5° C.;

removing the first refrigerant from the first heat exchanger, expanding it and returning it to the first heat exchanger while allowing the expanded first refrigerant to at least partially evaporate in the first heat exchanger thereby withdrawing heat from the hydrocarbon stream and thereby obtaining a cooled hydrocarbon stream;

removing the cooled hydrocarbon stream from the first heat exchanger.

The hydrocarbon stream and at least the first refrigerant are thus commonly cooled in the first heat exchanger. If upstream of the first heat exchanger the hydrocarbon stream and the first refrigerant are not commonly cooled, or that, as in some embodiments of the invention to be shown below, upstream of which first common heat exchanger there is no other common heat exchanger wherein the hydrocarbon stream and the first refrigerant stream can be commonly cooled, then the first heat exchanger is, for the purpose of the present specification, understood to be the first common heat exchanger. The first common heat exchanger may be the first one (the upstream-most one) in a series of consecutively arranged common heat exchangers.

The cooled hydrocarbon stream removed from the first heat exchanger may have a temperature of below −20° C., preferably of below −60° C. and more preferably of above −100° C. The cooled hydrocarbon stream removed from the first heat exchanger may be further cooled in a second heat exchanger thereby obtaining a liquefied hydrocarbon stream.

The hydrocarbon stream to be cooled may be any suitable hydrocarbon-containing stream, but is usually a natural gas stream obtained from natural gas or petroleum reservoirs. As an alternative the natural gas may also be obtained from another hydrocarbon source, also including a synthetic source such as a Fischer-Tropsch process.

Usually the hydrocarbon stream is comprised substantially of methane. Depending on the source, the hydrocarbon stream may contain varying amounts of hydrocarbons heavier than methane such as ethane, propane, butanes and pentanes as well as some aromatic hydrocarbons. The hydrocarbon stream may also contain non-hydrocarbons such as $H_2O$, $N_2$, $CO_2$, $H_2S$ and other sulphur compounds, and the like.

If desired, the hydrocarbon stream may be pre-treated before feeding it to the first heat exchanger or a pre-cooling heat exchanger. This pre-treatment may comprise removal of undesired components such as $H_2O$, $CO_2$ and $H_2S$, or other steps such as pre-cooling, pre-pressurizing or the like. As these steps are well known to the person skilled in the art, they are not further discussed here. Preferably, the temperature of the hydrocarbon stream after any pre-treating is considered to be the starting temperature of the hydrocarbon stream for the purpose of the present description.

The first refrigerant and optional second refrigerant (and any further refrigerants used) may be any suitable refrigerant. Although the first and optional second refrigerant may be a single component such as propane, it is preferred that the first and optional second refrigerants are both a multi-component refrigerant. Although such a multi-component refrigerant is not limited to a certain composition it usually comprises one or more components selected from the group consisting of nitrogen and lower straight or branched alkanes and alkenes such as methane, ethane, ethylene, propane, propylene, butane.

The person skilled in the art will understand that the expanding may be performed in various ways using any expansion device (e.g. using a throttling valve, a flash valve or a conventional expander).

Preferably, the hydrocarbon stream is, before feeding into the first heat exchanger, pre-cooled in a pre-cooling heat exchanger. It is preferred that the first and optional second refrigerants are, before feeding into the first heat exchanger, pre-cooled in a pre-cooling heat exchanger.

The first and optional second refrigerants may both be pre-cooled in a first pre-cooling heat exchanger, whereas the hydrocarbon stream may be pre-cooled in a second pre-cooling heat exchanger. Preferably, the first pre-cooling heat exchanger is not the second pre-cooling heat exchanger, and preferably the hydrocarbon stream is not pre-cooled in the first pre-cooling heat exchanger.

According to an especially preferred embodiment the cooled hydrocarbon stream removed from the first heat exchanger has a temperature below −20° C., preferably below −60° C. and preferably above −100° C. The cooled hydrocarbon stream removed from the first heat exchanger may then be preferably further cooled in a second heat exchanger (and optionally further heat exchangers) thereby obtaining a liquefied hydrocarbon stream such as LNG. If desired further cooling may be used, for example to obtain a sub-cooled LNG stream.

Apparatuses suitable for performing the methods describe herein may comprise:

a first heat exchanger having an inlet for a hydrocarbon stream and an outlet for a cooled hydrocarbon stream, an inlet and outlet for a first refrigerant, an optional inlet and optional outlet for an optional second refrigerant and an inlet for an expanded first refrigerant and an outlet for at least partially evaporated first refrigerant; and an expander for expanding the first refrigerant heat exchanged in the first heat exchanger between the outlet of the first heat exchanger for the first refrigerant and the inlet for the expanded first refrigerant.

Further, there may be provided a pre-cooling heat exchanger in which the hydrocarbon stream and/or the first and optional second refrigerants can be pre-cooled before feeding into the first heat exchanger.

Optionally, the apparatus may further comprise a second heat exchanger for further cooling the cooled hydrocarbon stream removed from the first heat exchanger thereby obtaining a liquefied hydrocarbon stream.

FIG. 1 schematically shows a process scheme (and an apparatus for performing the process generally indicated with reference No. 1) according to the first embodiment of the present invention for cooling a hydrocarbon stream 10 such as natural gas. The process scheme of FIG. 1 comprises a first heat exchanger 2, a first pre-cooling heat exchanger 3 and a second pre-cooling heat exchanger 4. Further, the process scheme comprises throttling valves 7, 8 and 9, a stream splitter 11 and said two air or water coolers 13, 14. The person skilled in the art will readily understand that further elements may be present if desired.

A hydrocarbon source 6 is arranged to provide a hydrocarbon stream to be cooled. the hydrocarbon stream is provided at a relatively low starting temperature (e.g. below 10 degrees celsius, preferably below 0 degrees celsius) as compared to a refrigerant temperature which is the temperature of a first refrigerant stream 130 after it leaves ambient cooler 13, which may be an air cooler or a water cooler.

According to the first embodiment, the ambient-cooled first refrigerant is further pre-cooled in the first pre-cooling heat exchanger 3, together with a second refrigerant, against a medium different from ambient that is allowed to flow into the first pre-cooling heat exchanger 3 via line 170*a* and inlet 34. The hydrocarbon stream is pre-cooled in the second pre-cooling heat exchanger 4. The hydrocarbon stream is not pre-cooled in the first pre-cooling heat exchanger 3. Thus, in this embodiment, the first and second pre-cooling heat exchangers are placed in parallel.

The pre-cooled first and second refrigerants (140, 240) and the pre-cooled hydrocarbon stream 30 are then commonly cooled in first heat exchanger 2, which is in this embodiment understood to be the first common heat exchanger.

The pre-cooled hydrocarbon stream is fed into the first heat exchanger 2 at a hydrocarbon feeding temperature that is lower than the refrigerant temperature. The pre-cooled first refrigerant is fed into the first heat exchanger 2 at a refrigerant feeding temperature that is lower than the refrigerant temperature (due to the pre-cooling in said first pre-cooling heat exchanger 3). Moreover, the temperature difference between the hydrocarbon feeding temperature and the refrigerant feeding temperature is lower than 60° C.

During use of the process scheme according to FIG. 1, a hydrocarbon stream 10 containing natural gas is supplied to the inlet 41 of the second pre-cooling heat exchanger 4 at a certain inlet pressure and inlet temperature. The inlet temperature is in this case the hydrocarbon starting temperature. Typically, the inlet pressure to the second pre-cooling heat exchanger 4 will be between 10 and 100 bar, preferably above 30 bar and more preferably above 70 bar. The temperature of the hydrocarbon stream 10 will usually be below 30° C., preferably below 10° C., more preferably below 5° C. and even more preferably below 0° C.

If desired the hydrocarbon stream 10 may have been further pre-treated before it is fed to the second pre-cooling heat exchanger 4. As an example, $CO_2$, $H_2S$ and hydrocarbon components having the molecular weight of propane or higher may also at least partially have been removed from the hydrocarbon stream 10.

In the second pre-cooling heat exchanger 4 the hydrocarbon stream 10 (fed at inlet 41) is pre-cooled by heat exchanging against a first refrigerant stream 180*a* being evaporated in the second pre-cooling heat exchanger 4 thereby removing heat from the hydrocarbon stream 10. Subsequently the hydrocarbon stream is removed (at outlet 45) as stream 30 from the second pre-cooling heat exchanger 4 and passed (whilst bypassing the first pre-cooling heat exchanger 3) to the first heat exchanger 2 for further cooling. To this end, stream 30 is fed at inlet 21 of the first heat exchanger 2, cooled, again by heat exchanging against (stream 155 of) the first refrigerant being evaporated in the first heat exchanger 2 thereby removing heat from the hydrocarbon stream 30 (as well as from the first refrigerant 140 being fed at inlet 22 and the second refrigerant 240 being fed at inlet 23), and removed as cooled hydrocarbon stream 40. Preferably, the cooled hydrocarbon stream 40 removed from the first heat exchanger 2 (at outlet 25) has a temperature below −20° C., preferably below −60° C. and preferably above −100° C.

Figure 4:
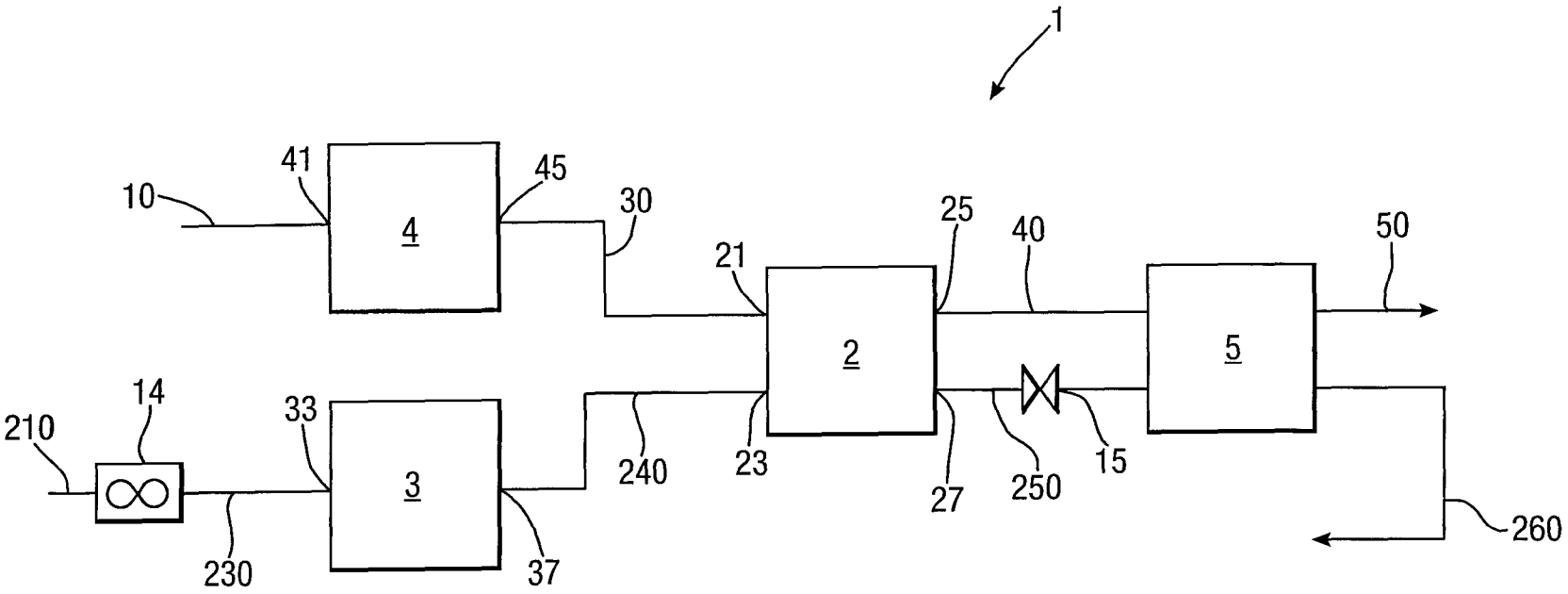
FIG. 4 schematically a process scheme in which the present invention is for obtaining a liquefied hydrocarbon stream.

As will be schematically shown in FIG. 4, cooled hydrocarbon stream 40 may be further cooled to obtain a liquefied hydrocarbon stream (stream 50 in FIG. 4) such as LNG.

The first and second refrigerants are both preferably cycled in separate closed refrigerant cycles (not fully shown in FIG. 1), and are preferably multi-component refrigerant streams.

The first refrigerant stream 110 is obtained from a compressor unit (109), cooled in air or water cooler 13 (after optional further cooling) and fed as stream 130 into first pre-cooling heat exchanger 3 (at inlet 32). after passing through the first pre-cooling heat exchanger 3, the first refrigerant 135 is split at splitters 11 and 12 into three sub-streams 140, 170 and 180.

The splitters 11 and 12 will usually be conventional splitters thereby obtaining at least two streams having the same composition. The splitters 11 and 12 may also be replaced by a single splitter thereby obtaining the at least three sub-streams 140, 170 and 180.

The first sub-stream 140 is passed to the first heat exchanger 2 (and fed at inlet 22), whilst the second and third sub-streams 170, 180 are expanded (in expanders 8 and 9) and passed to the first and second pre-cooling heat exchangers 3, 4, respectively.

The first sub-stream 140 of the first refrigerant is passed through the first heat exchanger 2, expanded in expander 7 and fed as stream 155 at inlet 24 of the first heat exchanger 2, at least partially evaporated thereby withdrawing heat from streams 30, 140 and 240, and removed as stream 160 from first heat exchanger 2 at outlet 28.

The expanded second sub-stream 170*a* is fed at inlet 34 of the first pre-cooling heat exchanger 3, at least partially evaporated thereby withdrawing heat from streams 130 and 230, and removed as stream 170*b* from first pre-cooling heat exchanger 3 at outlet 38.

The expanded third sub-stream 180*a* is fed at inlet 44 of the second pre-cooling heat exchanger 4, at least partially evaporated thereby withdrawing heat from stream 10, and removed as stream 180*b* from second pre-cooling heat exchanger 4 at outlet 48.

The evaporated first refrigerant streams 160, 170*b* and 180*b* are cycled to the compressor unit (109) for recompression purposes thereby re-obtaining stream 110.

The second refrigerant stream 210 is obtained from a second compressor unit (209), cooled in air or water cooler 14 (after optional further cooling) and fed as stream 230 into first pre-cooling heat exchanger 3 (at inlet 33). after passing through the first pre-cooling heat exchanger 3, the second refrigerant is passed as stream 240 to the first heat exchanger 2 (and fed at inlet 23). Then the second refrigerant is passed through the first heat exchanger 2 and removed at outlet 27 as stream 250. as shown in fig. 4, the second refrigerant stream 250 is passed to a second heat exchanger 5 for further cooling of the hydrocarbon stream 40.

Preferably, the temperature difference of the hydrocarbon stream 30 and at least one of the first refrigerant stream 140 and second refrigerant stream 240 just before feeding into the first heat exchanger 2 at inlets 21, 22, 23 is lower than 10° C., preferably lower than 5° C. Preferably the temperatures of the streams 30, 140, 240 are substantially the same.

Table I gives an overview of the estimated pressures and temperatures of the streams at various parts in an example process of FIG. 1. The hydrocarbon stream in line 10 of FIG. 1 comprised approximately the following composition: 92.1 mole % methane, 4.1 mole % ethane, 1.2 mole % propane, 0.7 mole % butanes and pentane and 1.9 mole % $N_2$. Other components such as $H_2S$ and $H_2O$ were previously substantially removed. The first and second refrigerant in streams 110, 210 were both multi-component refrigerants. Stream 110 was substantially composed of methane and (for a major part) of ethane, whilst stream 210 was substantially composed of ethane, propane, $N_2$ and (for a major part) of methane.

TABLE I

| Line | Pressure (bar) | Temperature (° C.) | Phase composition* |
|---|---|---|---|
| 10 | 92.5 | −10.0 | — |
| 30 | 91.5 | −25.0 | — |
| 40 | 90.5 | −62.7 | — |
| 110 | 58.2 | 65.7 | V |
| 130 | 57.1 | 9.5 | V/L |
| 140 | 55.6 | −25.0 | L |
| 150 | 54.1 | −62.7 | L |
| 160 | 9.3 | −35.2 | V |
| 170 | 55.6 | −25.0 | L |
| 170b | 27.0 | −2.8 | V |
| 180 | 55.6 | −25.0 | L |
| 180b | 18.0 | −14.3 | V |
| 210 | 56.1 | 61.9 | V |
| 230 | 55.8 | 9.5 | V |
| 240 | 54.3 | −25.0 | V/L |
| 250 | 52.3 | −62.7 | V/L |

*V = vapour, L = Liquid

An important advantage of the embodiment of FIG. 1 is that the amount of thermal stresses in the first heat exchanger 2 is reduced as the temperature difference of the hydrocarbon stream 30 and the first and second refrigerants 140, 240 when feeding into the first heat exchanger 2 is lower than 10° C., preferably lower than 5° C. Preferably (and as indicated in Table I) these temperatures are substantially the same (i.e. −25° C.). This has been achieved by cooling on the one hand stream 10 (in second pre-cooling heat exchanger 4) and on the other hand streams 110 and 210 (in first pre-cooling heat exchanger 3) in parallel heat exchangers. Thus, the hydrocarbon stream 10 or 30 is not pre-cooled in the first pre-cooling heat exchanger 3, but bypasses the same.

Figure 2:
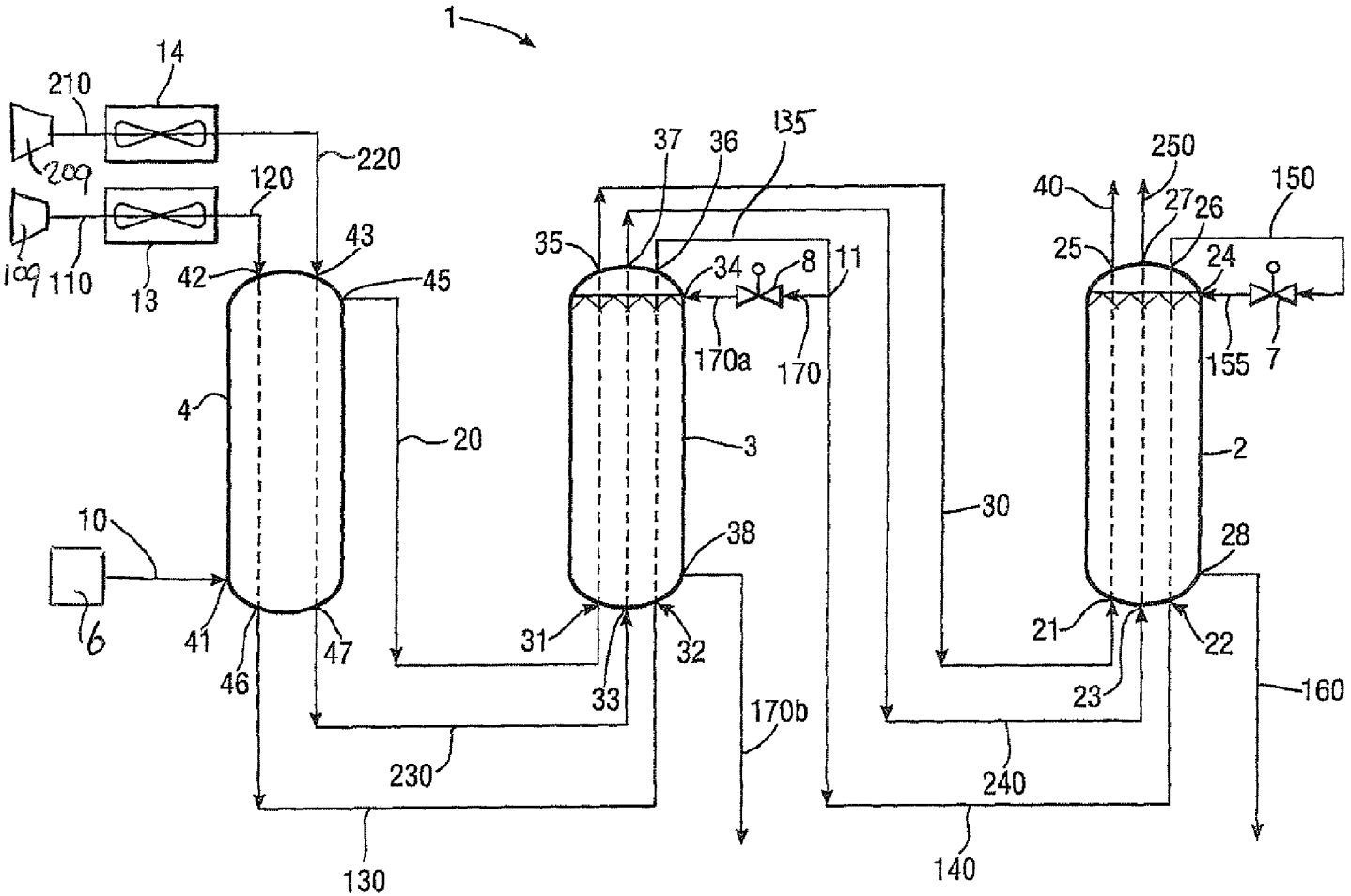
FIG. 2 schematically a process scheme of a second embodiment in accordance with the present invention.

FIG. 2 shows an alternative embodiment to FIG. 1, also reducing the amount of thermal stresses in the first heat exchanger 2, but at the same time using some of the cold in the hydrocarbon stream 10 to cool the first and second refrigerant streams 120, 220 as a result of which less cooling duty is required to cool the first and second refrigerants.

According to this alternative embodiment, the first and second refrigerants are both pre-cooled in a first pre-cooling heat exchanger 3 and a second pre-cooling heat exchanger 4. The hydrocarbon stream 10 is heat exchanged in the second pre-cooling heat exchanger 4 and cooled in the first pre-cooling heat exchanger 3, the first pre-cooling heat exchanger 3 being situated between the second pre-cooling heat exchanger 4 and the first heat exchanger 2.

If the hydrocarbon stream 10 is received at a starting temperature that is lower than the refrigerant temperature in line 120 (after having been cooled against ambient in cooler 13), the heat exchanging of the hydrocarbon stream 10 in the second pre-cooling heat exchanger 4 results in heating of the hydrocarbon stream. The hydrocarbon stream 10 then acts as a cooling medium other than ambient, against which the first and second refrigerant streams are further cooled after having been cooled against ambient in coolers 13, 14.

Where the hydrocarbon stream is heated in the second pre-cooling heat exchanger, the first pre-cooling heat exchanger 3 is understood to be the first common heat exchanger, because upstream of that first pre-cooling heat exchanger 3 the hydrocarbon stream and the first refrigerant stream are not commonly cooled.

In the embodiment of FIG. 2, the second pre-cooling heat exchanger 4 is in the form of a shell and tube heat exchanger wherein the inlet 41 for the hydrocarbon stream 10 is at the shell side, whilst inlets 42 (for first refrigerant stream 120) and 43 (for second refrigerant stream 220) are not. Contrary to the embodiment of FIG. 1, in FIG. 2 the hydrocarbon stream 10 is heat exchanged in the second pre-cooling heat exchanger 4 against the first and second refrigerant streams 120 and 220.

Further, instead of evaporating a part of the first refrigerant in the second pre-cooling heat exchanger 4 (stream 180*a* as shown in FIG. 1), the cold of the hydrocarbon stream 10 is used to cool the first and second refrigerant streams 120 and 220. Although the hydrocarbon stream 10 is preferably passed through the second pre-cooling heat exchanger 4 counter-currently to the streams 120 and 220 (as shown in FIG. 2), this may also be done co-currently.

After passing through the second pre-cooling heat exchanger 4, a heated hydrocarbon stream 20, a cooled first refrigerant stream 130 and a cooled second refrigerant stream 230 are removed from the second pre-cooling heat exchanger 4 (at outlets 45, 46 and 47 respectively) and passed (while having substantially the same temperature) to the first pre-cooling heat exchanger 3. Thus, in the embodiment of FIG. 2, the hydrocarbon stream does not bypass the first pre-cooling heat exchanger 3, but is fed as stream 20 at inlet 31 at a hydrocarbon feeding temperature and removed at outlet 35 of the first pre-cooling heat exchanger 3 before it is passed as stream 30 to the first heat exchanger 2.

It is noteworthy that according to the embodiment of FIG. 2 the feeding temperatures of streams 20, 130, 230 just before feeding into the first pre-cooling heat exchanger 3, as well as the temperatures of streams 30, 140, 240 are substantially the same, as a result of which thermal stresses in the first heat exchanger 2 as well as in the first pre-cooling heat exchanger 3 are minimized.

Table II gives an overview of the estimated pressures and temperatures of the streams at various parts in an example process of FIG. 2. The hydrocarbon stream in line 10 and the first refrigerant in stream 110 have the same composition as in FIG. 1. Stream 210 was composed of the same components as in FIG. 1, but with different ratios of the various components.

TABLE II

| Line | Pressure (bar) | Temperature (° C.) | Phase composition* |
|---|---|---|---|
| 10 | 92.5 | −10.0 | — |
| 20 | 92.2 | 6.9 | — |
| 30 | 91.2 | −26.6 | — |
| 40 | 90.2 | −61.5 | — |
| 110 | 58.2 | 67.7 | V |
| 120 | 57.1 | 9.5 | V/L |
| 130 | 55.6 | 6.9 | V/L |
| 140 | 54.1 | −26.6 | L |
| 150 | 52.6 | −61.5 | L |
| 160 | 9.7 | −33.3 | V |
| 170 | 54.1 | −26.6 | L |
| 170b | 23.7 | −6.2 | V |
| 210 | 57.0 | 62.5 | V |
| 220 | 56.7 | 9.5 | V |
| 230 | 55.2 | 6.9 | V |
| 240 | 53.7 | −26.6 | V/L |
| 250 | 51.7 | −61.5 | V/L |

*V = vapour, L = Liquid

Figure 3:
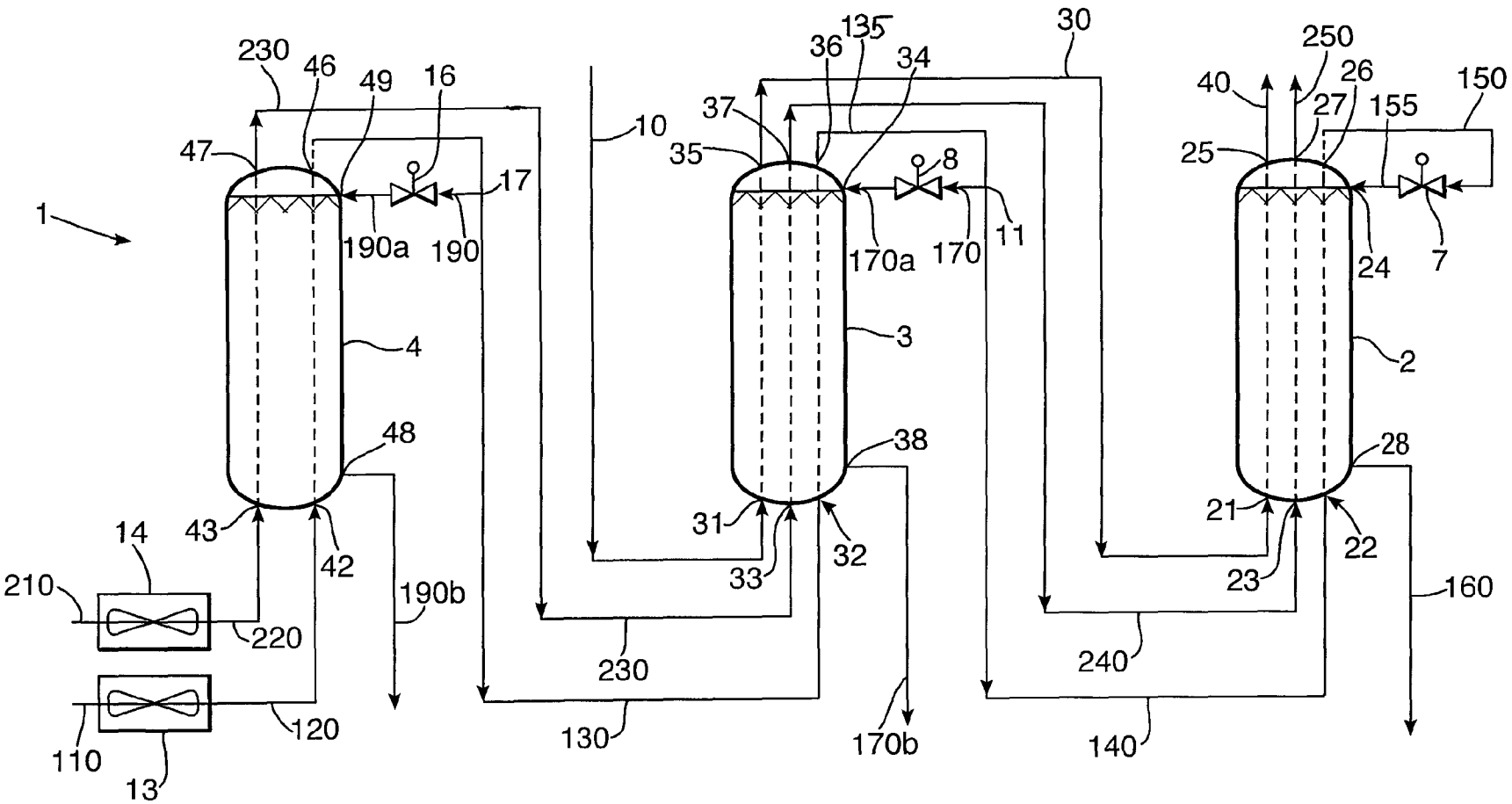
FIG. 3 schematically a process scheme of a third embodiment in accordance with the present invention.

FIG. 3 shows a third embodiment according to the present invention. According to this third embodiment, the first refrigerant 120 and optional second refrigerant 220, after having been cooled against ambient in respective coolers 13, 14, are both pre-cooled in a first (3) and a second (4) pre-cooling heat exchanger, the first pre-cooling heat exchanger 3 being situated between the second pre-cooling heat exchanger 4 and the first heat exchanger 2.

Further, the first refrigerant is, after passing through the second pre-cooling heat exchanger 4, split in at least two sub-streams (130, 190) by means of splitter 17. A first sub-stream 130 of the at least two sub-streams is passed to the first pre-cooling heat exchanger and a second sub-stream 190 of the at least two sub-streams is expanded by means of expander 16 and returned to the second pre-cooling heat exchanger 4 while allowing the expanded second sub-stream 190*a* to at least partially evaporate in the second pre-cooling heat exchanger 4.

The first refrigerant thus forms the medium other than ambient against which the first and second refrigerants 120, 220 are further cooled.

In this respect it is preferred that the pressure at which the expanded second sub-stream 190*a* of the first refrigerant is evaporated in the second pre-cooling heat exchanger 4 is higher than the pressure at which the expanded first refrigerant 170*a* is evaporated in the first pre-cooling heat exchanger 3.

According to the embodiment shown in FIG. 3, the hydrocarbon stream 10 bypasses the second pre-cooling heat exchanger 4 and is fed into the first pre-cooling heat exchanger 3 in order to be cooled against the first refrigerant stream 170*a* being at least partly evaporated in the first pre-cooling heat exchanger 3, thereby withdrawing heat from the hydrocarbon stream 10 as well as from the first and second refrigerant streams 130 and 230. Thus, in this third embodiment, the first pre-cooling heat exchanger 3 is understood to be the first common heat exchanger.

The first and second refrigerants are both pre-cooled in a first and a second pre-cooling heat exchanger (3, 4), the first pre-cooling heat exchanger 3 being situated between the second pre-cooling heat exchanger 4 and the first heat exchanger 2. The first refrigerant, after passing through the second pre-cooling heat exchanger 4, is split at splitter 17 in at least two sub-streams 130, 190, a first sub-stream 130 of which being passed to the first pre-cooling heat exchanger 3 and a second sub-stream 190 of which being expanded and returned to the second pre-cooling heat exchanger 4, while allowing the expanded second sub-stream 190*a* to at least partially evaporate in the second pre-cooling heat exchanger 4.

The pressure at which the expanded second sub-stream 190*a* of the first refrigerant 130 is evaporated in the second pre-cooling heat exchanger 4 is preferably higher than the pressure at which the expanded first refrigerant 170*a* is evaporated in the first pre-cooling heat exchanger 3.

First and second refrigerant streams 130 and 230 have been previously cooled (as streams 120 and 220—after cooling in coolers 13 and 14, respectively—) in second pre-cooling heat exchanger 4 to ensure that streams 130 and 230 have substantially the same temperature.

To this end the first refrigerant stream 130 is split in splitter 17 thereby obtaining at least one additional sub-stream 190 that is expanded using an expander, here in the form of throttling valve 16. The expanded first refrigerant stream 190*a* is connected to inlet 49 of the second pre-cooling heat exchanger 4, so that it can then at least partially evaporate (after feeding into the second pre-cooling heat exchanger 4 at inlet 49) thereby obtaining evaporated stream 190*b*, in order to remove heat from the first and second refrigerant streams 120 and 220. For the sake of completeness, it is remarked that the first sub-stream 130 is connected to inlet 32 of the first pre-cooling heat exchanger 3.

Preferably the pressure at which the expanded first refrigerant streams 190*a*, 170*a*, 155 are evaporated decreases from the second pre-cooling heat exchanger 4 to the first pre-cooling heat exchanger 3 to the pre-cooling heat exchanger 2. this is beneficial, in particular if the hydrocarbon stream 10 is very cold, as a part of the cooling duty is shifted to the second pre-cooling heat exchanger 4 being operated at a relatively high pressure. this results in a save on compression power in the compression unit to which the evaporated first refrigerant streams 160, 170*b*, (180*b* if available; see FIG. 2) and 190*b* are cycled for recompression purposes.

Table III gives an overview of the estimated pressures and temperatures of the streams at various parts in an example process of FIG. 3. The hydrocarbon stream in line 10 and the first refrigerant in stream 110 have the same composition as in FIG. 1. Stream 210 was composed of the same components as in FIG. 1, but with different ratios of the various components.

TABLE III

| Line | Pressure (bar) | Temperature (° C.) | Phase composition* |
|---|---|---|---|
| 10 | 92.5 | −10.0 | — |
| 30 | 91.5 | −40.0 | — |
| 40 | 90.5 | −68.3 | — |
| 110 | 58.2 | 64.8 | V |
| 120 | 57.1 | 9.5 | V/L |
| 130 | 55.6 | −10.0 | L |
| 140 | 54.1 | −40.0 | L |
| 150 | 52.6 | −68.3 | L |
| 160 | 7.1 | −43.0 | V |
| 170 | 54.1 | −40.0 | L |
| 170b | 16.6 | −17.0 | V |
| 190 | 55.6 | −10.0 | L |
| 190b | 36.0 | 8.1 | V |
| 210 | 52.4 | 59.6 | V |
| 220 | 52.0 | 9.5 | V |
| 230 | 50.5 | −10.0 | V |
| 240 | 49.0 | −40.0 | V/L |
| 250 | 47.0 | −68.3 | V/L |

*V = vapour, L = Liquid

It is preferred according to embodiments of the present invention, that the temperature difference of the hydrocarbon stream (10 in FIG. 3 or 20 in FIG. 2) and the first and second refrigerants (130 and 230) just before cooling in the first pre-cooling heat exchanger 3 is preferably lower than 10° C., preferably lower than 5° C.

Furthermore, the embodiments of FIGS. 1, 2, and 3 have in common that the first refrigerant 135, after passing through a first pre-cooling heat exchanger 3, is split in at least two sub-streams (e.g. 140, 170, 180).

Apparatuses may comprise a splitter 11 for splitting the first refrigerant 135 into said at least two sub-streams. A first sub-stream 140 of the at least two sub-streams may be connected to an inlet 22 of the first heat exchanger for being passed to the first heat exchanger 2. A second sub-stream 170 of the two sub-streams may be connected via an expander 8 to an inlet 34 of the first pre-cooling heat exchanger 3, for being expanded and returned to the first pre-cooling heat exchanger 3 while allowing the expanded second sub-stream 170*a* to at least partially evaporate in the first pre-cooling heat exchanger 3. The pressure at which the expanded second sub-stream 170*a* of the first refrigerant 140 is evaporated in the first pre-cooling heat exchanger 3 is preferably higher than the pressure at which the expanded first refrigerant 155 is evaporated in the first heat exchanger 2.

A third sub-stream 180 may be connected by means of an expander 9 to an inlet 44 of the second pre-cooling heat exchanger 4 for being expanded, and subsequently passed to the second pre-cooling heat exchanger 4, while allowing the expanded third sub-stream 180*a* to evaporate in the second pre-cooling heat exchanger 4. This is schematically shown in FIG. 1.

As is schematically shown in FIG. 4 (in which the first refrigerant has been omitted for ease of understanding), the cooled hydrocarbon stream 40 may be further cooled or even liquefied in at least a second heat exchanger 5 thereby obtaining a liquefied hydrocarbon stream 50 such as LNG. In the embodiment of FIG. 4 the second refrigerant stream 250 as obtained in FIG. 1 is to this end expanded in expander 15 and evaporated to remove heat from the cooled hydrocarbon stream 40. The evaporated second refrigerant stream 260 may be recompressed and cooled (not shown) in order to re-obtain stream 210.

The person skilled in the art will readily understand that many modifications may be made without departing from the scope of the invention. As an example, the first and second pre-cooling heat exchangers as well as the first and second heat exchangers may be any type of heat exchangers including spool wound or plate fin heat exchangers. Further, each heat exchanger may comprise a train of heat exchangers.

What is claimed is:

1. Method for cooling a hydrocarbon stream, wherein the hydrocarbon stream and a first refrigerant stream are commonly cooled against an evaporating refrigerant in a series of one or more consecutively arranged common heat exchangers, which series comprises a first common heat exchanger, upstream of which first common heat exchanger the hydrocarbon stream and the first refrigerant stream are not commonly cooled, the method at least comprising the steps of:

(a) compressing a first refrigerant stream to obtain a compressed first refrigerant stream;

(b) cooling the compressed first refrigerant stream against ambient to a refrigerant temperature;

(c) receiving a hydrocarbon stream to be cooled at a starting temperature that is lower than the refrigerant temperature;

(d) feeding the hydrocarbon stream into the first common heat exchanger at a hydrocarbon feeding temperature that is lower than the refrigerant temperature;

(e) further lowering the temperature of the first refrigerant stream, after said cooling of step (b), by heat exchanging against a medium different from ambient;

(f) feeding the first refrigerant stream into the first common heat exchanger, after said heat exchanging of step (e), at a refrigerant feeding temperature, wherein the refrigerant feeding temperature is lower than the refrigerant temperature, and wherein the temperature difference between the hydrocarbon feeding temperature and the refrigerant feeding temperature is lower than 60° C.;

(g) commonly cooling the hydrocarbon stream and the first refrigerant stream against an evaporating refrigerant in the series of one or more consecutively arranged common heat exchangers wherein said medium different from ambient comprises the hydrocarbon stream received in step (c) prior to said feeding of the hydrocarbon stream into the first common heat exchanger in step (d).

2. Method according to claim 1, wherein said temperature difference is lower than 5° C.

3. Method according to claim 2, wherein the hydrocarbon feeding temperature and the refrigerant feeding temperature are substantially the same.

4. Method according to claim 1, wherein said temperature difference is smaller than an initial temperature difference between said starting temperature and said refrigerant temperature.

5. Method according to claim 1, comprising:

(h) removing the hydrocarbon stream from the series of one or more consecutively arranged common heat exchangers as a cooled hydrocarbon stream.

6. Method according to claim 5 comprising:

(i) further cooling the cooled hydrocarbon stream removed in step (h) in at least a second heat exchanger thereby obtaining a liquefied hydrocarbon stream.

7. Method according to claim 1, further comprising feeding a second refrigerant into the first common heat exchanger.

8. Method according to claim 7, wherein in addition to the first refrigerant stream and hydrocarbon stream, also the second refrigerant is commonly cooled in step (g).

9. Method according to claim 7, wherein, before feeding the second refrigerant into the first common heat exchanger, the second refrigerant stream is compressed to obtain a compressed second refrigerant stream, cooled against ambient, and further cooled by heat exchanging against a medium different from ambient.

10. Method according to claim 1, wherein said commonly cooling the hydrocarbon stream and the first refrigerant stream against an evaporating refrigerant comprises:

removing the first refrigerant from the first common heat exchanger;

expanding it; and returning it to the first common heat exchanger while allowing the expanded first refrigerant to at least partially evaporate in the first common heat exchanger thereby withdrawing heat from the hydrocarbon stream and at least the first refrigerant stream.

11. Apparatus for cooling a hydrocarbon stream, the apparatus comprising:

a first refrigerant stream;

a compressor arranged to compress the first refrigerant stream to obtain a compressed first refrigerant stream;

an ambient cooler arranged to cool the compressed first refrigerant stream against ambient to a refrigerant temperature;

a pre-cooling heat exchanger arranged to receive the cooled compressed first refrigerant stream and to further lower the temperature of the first refrigerant stream by heat exchanging against a medium different from ambient;

a hydrocarbon source arranged to provide a hydrocarbon stream to be cooled at a starting temperature that is lower than the refrigerant temperature;

a series of one or more consecutively arranged common heat exchangers arranged to receive and commonly cool at least the hydrocarbon stream and the first refrigerant stream, which series comprises a first common heat exchanger, such that upstream of which first common heat exchanger there is no other common heat exchanger wherein the hydrocarbon stream and the first refrigerant stream can be commonly cooled;

a hydrocarbon inlet on the first common heat exchanger arranged to receive the hydrocarbon stream at a hydrocarbon feeding temperature lower than the refrigerant temperature;

a first refrigerant inlet on the first common heat exchanger arranged to receive the first refrigerant from the pre-cooling heat exchanger at a refrigerant feeding temperature that is lower than the refrigerant temperature, and such that the temperature difference between the hydrocarbon feeding temperature and the refrigerant feeding temperature is lower than 60° C., wherein said medium different from ambient comprises the hydrocarbon stream between the hydrocarbon source and the hydrocarbon inlet on the first common heat exchanger.

12. Apparatus as claimed in claim 11, further comprising a second heat exchanger for further cooling the cooled hydrocarbon stream removed from the series of common heat exchangers, thereby obtaining a liquefied hydrocarbon stream.

13. Apparatus as claimed in claim 12, further comprising a second refrigerant being commonly cooled in the series of common heat exchangers.

14. Apparatus as claimed in claim 11, wherein the first common heat exchanger comprises an inlet and an outlet for the first refrigerant and an inlet for an expanded first refrigerant, the apparatus further comprising an expander for expanding the first refrigerant between the outlet for the first refrigerant and the inlet for the expanded first refrigerant.

15. Method according to claim 1, wherein the hydrocarbon stream comprises natural gas.

* * * * *